US005317994A

United States Patent [19]

Evans

[11] Patent Number: 5,317,994

[45] Date of Patent: Jun. 7, 1994

[54] ENGINE COOLING SYSTEM AND THERMOSTAT THEREFOR

[76] Inventor: John W. Evans, 253 Rte. 41 North, Sharon, Conn. 06069

[21] Appl. No.: 947,144

[22] Filed: Sep. 18, 1992

[51] Int. Cl.[5] ..... F01P 7/14

[52] U.S. Cl. ..... 123/41.1; 236/34.5; 236/101 C

[58] Field of Search ..... 123/41.1; 236/34, 34.5, 236/101 C

[56] References Cited

U.S. PATENT DOCUMENTS 2,871,836 2/1959 Doughty ..... 123/41.1
3,858,800 1/1975 Wong ..... 236/34
4,550,694 11/1985 Evans ..... 123/41.2

*Primary Examiner*—Noah P. Kamen
*Attorney, Agent, or Firm*—Lyman R. Lyon

[57] ABSTRACT

A reverse flow cooling system for an internal combustion engine wherein coolant flows first into the cylinder head cooling chamber and then downwardly into the cooling chambers surrounding the cylinders comprises a thermostatically controlled valve having a valve spool movable between spaced and aligned inlet and outlet ports to control flow therethrough. The inlet port and outlet ports of the valve are sized so as to exhibit a combined resistance to flow equal to or less than the resistance to flow of the inlet port whereby coolant flowing through said thermostat exhibits minimum pressure drop.

2 Claims, 1 Drawing Sheet

ENGINE COOLING SYSTEM AND THERMOSTAT THEREFOR

BACKGROUND OF THE INVENTION

Nucleate boiling is the familiar bubbling process which may be so gentle that only small bubbles are produced or extremely vigorous if the fluid interface temperature is sufficiently high. Such nucleation within a liquid in contact with a solid heating surface occurs at minute cavities or other irregularities in the surface. If the coolant has a high tendency to wet the surface such as the non-aqueous coolants discussed in my U.S. Pat. No. 5,031,579, the shape of the bubble is pinched in at the metal surface and readily detaches itself. If, on the other hand, the coolant has a low tendency to wet the surface such as an aqueous engine coolant, for example, a 50/50 water ethylene glycol solution discussed in my co-pending application Ser. No. 907,392, filed Jul. 1, 1992, the bubble grows at the surface and is set free only when it is comparatively large. Experiments have shown that when the temperature of the heating surface is first raised above that of the surrounding bulk liquid, most of the temperature drop takes place across the very thin layer of liquid adjacent to the surface. As the temperature difference is increased the thickness of the layer also increases at a rate approximately proportional to the increase in temperature differential. This state of affairs does not continue indefinitely, however, since the rate of increase of thickness decreases and the layer reaches its maximum when bubbles form. The vapor bubble promotes turbulence as well as being a carrier of latent heat of vaporization. Bubbles formed on the surface in this superheated layer force back the liquid immediately surrounding them and, on breaking free from the surface, the surrounding liquid is caused to flow to the space previously occupied by the bubbles. The rapid growth and departure of many bubbles, and the resulting source and wake flows in the liquid, cause large oscillations in the superheated film. It is generally accepted that the major portion of the heat for bubble growth is transferred from the heating surface to the bubble by the superheated liquid layer through a conduction or convection process. The growth and departure of the bubble breaks down the superheated film and brings cool liquid to the heating surface. It is also to be noted that, as indicative from testing and in numerous technical references, increasing the coolant velocity reduces the metal temperature in the convection region for a given heat flux and also suppresses nucleate boiling.

In order to achieve peak efficiency of coolant flow in the non-aqueous cooling system taught in my U.S. Pat. No. 5,031,579 and for the aqueous reverse-flow system taught in my co-pending application Ser. No. 907,392, it is desirable to control the volume of vapor, or in other words, nucleate boiling generated in the head chamber. Additionally, it is desirable, when employing a reverse-flow coolant direction, to offset the dynamic loss exhibited in conventional systems wherein upward motion of the coolant assists the natural buoyancy of the coolant vapor to release from the critical metal surfaces in the head cooling chamber over the area of the combustion chamber domes. The dynamic's of coolant vapor resistance to release from the metal surface of the cooling jacket is a major defect of known aqueous reverse-flow cooling systems.

Accordingly, cooling flow rate through the head cooling chamber must be established to create turbulence on the metal surfaces, particularly the surfaces over the combustion domes. When the proper flow rate is established three major improvements occur all of which tend to reduce the volume of vapor generated in the head chamber.

(1) As shown by testing, the metal temperature at any given heat flux will be reduced and nucleate boiling will be suppressed due to a reduction in vapor points of origin.

(2) The total heat exchange value will be of a higher magnitude for any given load or heat flux because of the increase in "bulk" heat exchange from the metal to the coolant. The metal will stay under control evidencing a longer rise time to the nucleate boil point.

(3) In reverse flow systems, turbulence and coolant scrubbing of vapor off metal surfaces increases with the flow of the coolant, compensating for the dynamic directional flow lost as exhibited in conventional upward flow systems. Coolant turbulence dictated by higher flow velocities not only breaks away vapor on the hot jacket surfaces over the combustion domes, but by breaking away, the vapor allows improved "wetting" of the surface. "Wetting" of the surface increases contact of the coolant at critical hot spots and effects a reduction of nucleate boiling and a reduction of vapor generations.

The efficiency of the pump is a factor in establishing the proper flow for the non-aqueous system taught in my U.S. Pat. No. 5,031,579 as well as in the aqueous reverse-flow cooling system taught in my co-pending application Ser. No. 907,392. It is to be noted that many pumps currently used in production vehicles which may appear to produce insufficient flow, become usable if the other components of the system are maximized for proper flow. One such important component is the thermostat.

SUMMARY OF THE INVENTION

The aforesaid problem of maximizing coolant flow is solved, in accordance with the present invention, by an improved proportioning type thermostat. Proportioning thermostats have heretofore been used to take coolant, in varying proportions, from the engine and the radiator and segregate or blend coolant from each circuit to effect rapid coolant warm-up, with a steady and consistent temperature gain throughout the warm-up. The cooling system will rapidly rise to the preset temperature, and "lock-on" to that temperature without dips, or temperature swings, associated with the conventional "poppet" thermostat.

Although such stable temperature control is exhibited by the thermostat of the present invention, a unique and more important feature is evidenced whereby total coolant flow from the coolant pump passes through the engine, at all times, no matter what the position of the thermostat's internal valving or at what temperature the coolant, and engine are operating. Stated in another manner, 100% of the coolant flow from the pump is passed continually over the metal surfaces of the head chamber of the engine at all engine speeds. Therefore, maximum turbulence and coolant velocity for each coolant operating temperature is achieved at the metal surfaces of the head chambers. With the conventional thermostat, of the single "poppet" type, the opening, or orifice, of the thermostat varies with each different coolant temperature, unaffected by engine and pump RPM, and the flow rate is raised or lowered by the amount of the opening at each coolant temperature.

To achieve maximum flow the ports of the herein disclosed thermostat are sized so as to minimize pressure drop of the output of the pump. The internal orifices of the thermostat are designed to achieve the maximum flow capability that the thermostat housing will allow in order to approach or equal the flow capability of the port which each controls. The inlet port of thermostat flows constantly into the housing thereof and is sized to equal the total flow capability of each outlet port.

BRIEF DESCRIPTION OF THE DRAWINGS

FIG. 3 is a schematic view of yet another embodiment of the invention; an

DETAILED DESCRIPTION OF THE PREFERRED EMBODIMENTS OF THE INVENTION

Figure 1:
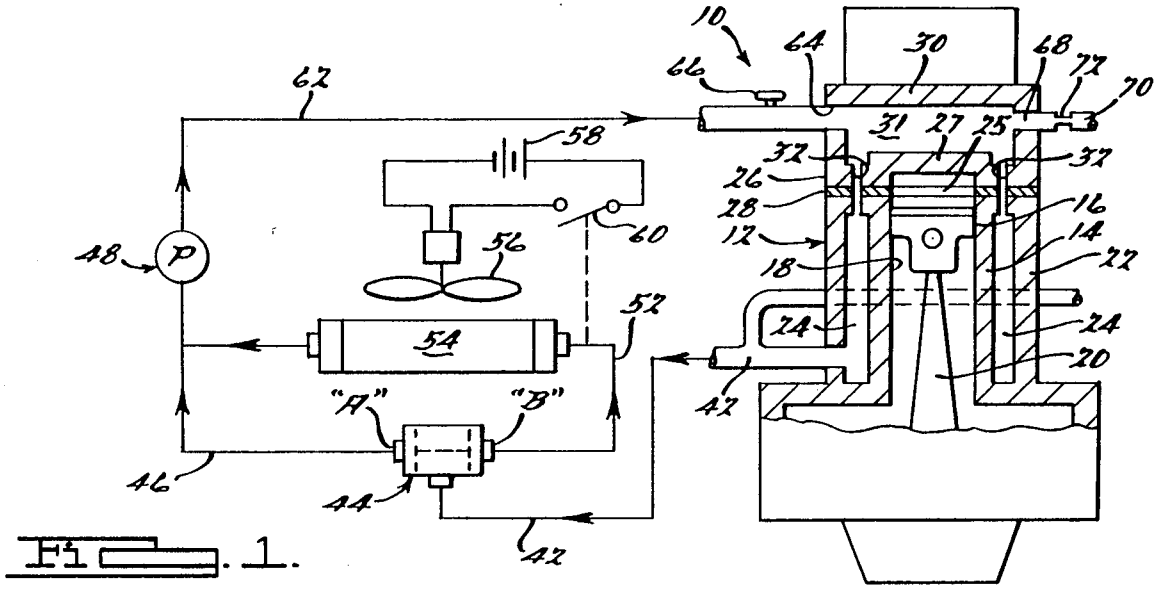
FIG. 1 is a schematic view, partially in section of the cooling system of the present invention applied to a conventional internal combustion engine.

As seen in FIG. 1, an internal combustion engine 10 embodying the cooling system of the present invention, comprises an engine block 12 having a cylinder wall 14 formed therein. A piston 16 reciprocates within a complementary cylinder bore 18. The piston 16 is coupled to a crank shaft (not shown) by a connecting rod 20.

A block coolant jacket 22 surrounds the cylinder wall 14, and is spaced therefrom so as to define a block coolant chamber 24 therebetween. The block coolant chamber 24 accommodates coolant flow therethrough to cool the metal surfaces of the engine 10.

A combustion chamber 25 is defined by a cylinder head 26 having a combustion chamber dome 27 therein defining and disposed above the combustion chamber 25. A head gasket 28 is seated between the cylinder head 26 and the engine block 12. The cylinder head 26 includes an upper jacket portion 30 which, in conjunction with the combustion chamber dome 27, defines a head coolant chamber 31. The head gasket 28 seals the combustion chamber 25 from the coolant chamber 31 and, likewise, seals the coolant chamber 31 from the exterior of the engine 10. A plurality of coolant ports 32 extend through the base of the cylinder head 26, through the head gasket 28, and through the top of the block coolant jacket 22.

In accordance with reverse-flow technology, engine coolant flows from the head coolant chamber 31, through the coolant ports 32, and into the block coolant chamber 24. Coolant then flows from the block coolant chamber 24 through a "full flow" coolant line 42 to a proportional thermostatic valve 44. An outlet "A" of the valve 44 is coupled to a radiator bypass line 46 leading to the inlet side of a pump 48. The size of the pump 48 is determined to achieve the coolant flow rates required under maximum operating loads.

An outlet "B" of the valve 44 is coupled to a radiator line 52. The valve 44 is set to detect a threshold temperature of the coolant flowing through full flow the coolant line 42. If the temperature of the coolant is below the threshold, the valve 44 directs a proportional amount of coolant through the bypass line 46. If, on the other hand, the coolant temperature is above the threshold, the valve 44 directs the coolant into the radiator line 52.

The other end of the radiator line 52 is coupled to a radiator 54. An electric fan 56 is mounted in front of the radiator 54 and is powered by a vehicle battery 58. The fan 56 is controlled by a thermostatic switch 60 which is coupled to the radiator line 52. Depending upon the temperature of the coolant in the radiator line 52, the thermostatic switch 60 operates the fan 56 to increase the airflow through radiator 54, and thus increase the heat exchange with the hot coolant.

Both the output of the radiator 54 and the bypass line 46 are coupled to the inlet side of the pump 48. The outlet side of the pump 48 is connected to a coolant return line 62. The coolant return line 62 is in turn coupled to an input port 64 anywhere in the coolant chamber 31 of the cylinder head 26. Thus, depending upon the temperature of the coolant flowing through the coolant line 42, the coolant flows either through the bypass line 46 or the radiator 54, which are both in turn coupled, through the pump 48, to the return line 62.

During engine warm-up, when the coolant temperature is relatively low, coolant is directed by the valve 44 through the bypass line 46. However, once the engine is warmed-up, at least some of the coolant is directed through the radiator 54. The lower temperature coolant flowing through the input line 62 flows through the input port 64 and into the cylinder head coolant chamber 31. The radiator 54 is chosen to accommodate desired coolant flow rates.

An air bleed valve 66 is mounted on the input line 62 above the input port 64 to bleed air from the engine cooling system when filling the system with coolant. The air bleed valve 66 is located at or above the highest coolant level in the engine to efficiently purge the engine 10 of trapped air when it is initially filled with coolant.

As taught in my application, Ser. No. 907,392, a vent 68 is provided at the highest point of the cylinder head coolant chamber 31. The vent 68 is connected to a vent line 70 which is either of relatively small inside diameter or, alternately, contains an in-line restrictor 72. The other end of the line 70 is connected to an inlet port 74 of a separator/condenser (not shown). The restrictor 72 maintains a pressure differential between the cylinder head chamber 31 and the vapor separator/condenser as well as limiting the flow of coolant through line 70 while permitting a major fraction of the coolant vapor collected in the head chamber 31 to pass to the separator/condenser.

In operation the coolant pump 48 draws upon both line 46 and upon radiator 54 connected to line 52. When the engine is cold the thermostatic valve 44 will totally close port "B" and totally open port "A." Hence total coolant flow will pass through the engine jackets 31 and 24 pass out line the full flow 42 into thermostat 44 and out through the wide open port "A." The coolant total flow will then pass through line 46 to pump 48 then through line 62 back into the engine at inlet 64 completing the circuit. This circuit continues until the coolant becomes heated and at a pre-selected setting the thermostat 44 will start to slowly close port "A" and open port "B" sending some of the coolant to the radiator 54. However, by the superior flow capability of the internal structure of the valve 44 the total coolant flow available from full flow line 42 into the "IN" port of the thermostat 44 will pass through the valve 44 to the coolant pump 48 by the shuttling effect of the valve selectively passing coolant out both ports A and B whereby the resultant flow of both line 46 and 52 is the total flow potential of the coolant pump 48 at any coolant temperature and pump RPM.

Figure 4:
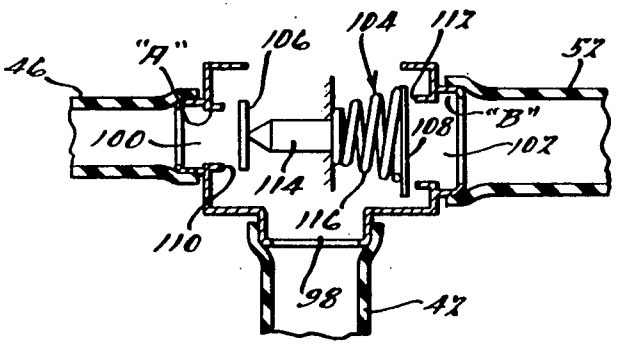
FIG. 4 is a diagrammatical cross-sectional view of the thermostat of the present invention.

As seen in FIG. 4, the thermostatic valve 44 achieves the desired result of maximum flow with minimum pressure drop by the following unique structure. The "full flow" inlet line 42, and the line 52 which connects the thermostatic valve 44 to the radiator 54 as well as by-pass line 46 which connects to the coolant pump 48 thereby by-passing the radiator 54 during warm-up, must be adequately sized to flow coolant at a rate sufficient for use with the system disclosed and claimed in my U.S. Pat. No. 5,031,579 and co-pending application Ser. No. 907,392. With sufficient coolant flow rates through the "full flow" inlet line 42, and outlet lines 46 and 52, or a combination of the two, the ports 98, 100, and 102 which connect lines 42, 46 and 52, respectively, to the thermostatic valve 44 must be sized so that the connection of lines 42, 46 and 52 does not create a pressure drop due to inlet or outlet restriction, before factoring in the pressure and flow resistance of an internal thermostat control valve 104. A main foot 108 on the internal valve 104 shuts off the flow through the radiator line 52 by closure against a port seat 112. A by-pass foot 106 shuts off flow through by-pass line 46 by closure against a port seat 110. The outlet ports 100 and 102 are selectively opened and closed by action of heat upon a pellet 114 of the valve 104, causing it to expand, and compress a valve spring 116.

When the coolant is cold the pellet 114 contracts and the spring 116 expands forcing the main foot 108 against port seat 112 and lifting by-pass foot 106 away from port seat 110. At full coolant operating temperatures, and above, the converse is effected and the pellet 114 expands, compressing spring 116, closing the by-pass outlet 100 and fully opening the main outlet 102 to the radiator line 52. At each incremental temperature gradient between cold coolant, (full by-pass, no radiator flow), and hot coolant (no by-pass, full radiator flow), there are proportional changes of the control valve 104 and changes in the blended coolant ratio flowing out of ports 100 and 102.

Typically the by-pass port 100 may be of smaller size that the main outlet port 102. Additionally the by-pass hose 46 would also then be smaller than main line 52. This size difference is normally found because there is no radiator core resistance to the coolant flowing through the bypass line 46 while all coolant passing through main line 52 must meet with the resistance of the radiator core. However, it is extremely important that once the proper sizes of line 46 and 52 have been established to achieve the maximum flow and minimum pressure drop of system requirements, and as the lines related to "constant flow" inlet port 98, then the outlet port seat 110 and 112 must be established of similar size so not to cause any significant additional loss in flow, or increase in pressure drop.

Extensive testing and experience has shown that the following procedure and general formula will most often identify the port sizing required;

(1) The engine to be fitted with the cooling system is run on a dynamometter and critical engine functions are mapped (i.e., spark setting, knock, metal temperature, BSFC, MBT, fuel economy, and emissions). An infinitely controlled heat exchanger is used for mapping, with only a single inlet and outlet hose employed (no by-pass circuit). All tests are run at steady state RPM and at full operating temperature. Thus, by varying the inlet hose size, for the test runs, the optimum hose size can be selected. The selected hose size will also be the "full flow" port size to which the pump will deliver coolant.

(2) Once the "full flow" port size has been identified, on the dynamometer, then the following formula will generally apply:

With: "A" being a variable port designated the by-pass port, "B" being a second variable port designated the main outlet port, and "C" being a full flow port, Then: The cross-sectional areas of A,B & C must have the following ratio's:

(1) Always

A+B= OR > than C (2) Preferably

A+B> than C, while B = OR > than C

The final thermostat, configured as above, is then installed on the engine and proper operation confirmed both on the dynamometer. If critical functions deteriorate after installing the thermostat on the engine, the A, and B port sizes will have to be increased. Since the internal "valve spool" and closure feet will always create additional flow resistance, it is extremely important to initially properly size the ports A, B and C for minimum pressure drop at the required coolant flow rates.

The interrelation of the diameter of the main outlet port seat 112 to the established distance of the by-pass foot 106 to the port seat 110 is also of critical important. The diameter of seat 112 must be large enough, and the distance between the foot 106 and port seat 110 great enough so that the travel of the valve 104, as the coolant temperature rises, is long enough to effect an opening of the main port 102 substantial enough to not restrict total coolant flow or a rise in pressure drop as by by-pass foot 106 progressively closes off the by-pass port 100.

The proportioning thermostat as depicted in FIG. 4 and described above is termed a "draw-through" type construction. The "draw-through" construction is the most sensitive to port sizing and flow resistance because it is connected to the negative, or vacuum, side of the coolant pump 48 which is the less efficient side of the pump. Centrifugal coolant pumps, typically used, can push much between than they can draw. Compounding the problem is that the radiator core resistance is also typically on the draw side, of the pump, as shown in FIG. 1.

In order to maximize the total engine jacket flow characteristics of the valve 44, other components which exhibit flow resistance limitations should be addressed. The radiator 54 flow curves must be studied and radiator tubing size addressed so that when the valve 44 completely closes the port "A," flow through the fully open port "B" and the radiator 54 is not reduced. It is also important to size the internal ports 32 of the engine so that the maximum flow potential of the engine cooling jacket structure is realized. An additional benefit when employing a thermostatic valve 44 as shown and described above is the total elimination of the third major defect of non-aqueous and aqueous reverse-flow cooling system. The operation of the thermostat 44 described above eliminates any chance of "cold-flooding" the head chamber 31. During cold ambient and high load conditions, the function of the thermostat assures that only a constant "blended" coolant, at a preset temperature, is drawn selectively from line 46 and the radiator 54 and line 52. The application of a proportioning thermostat to eliminate "cold coolant" shock caused by feeding radiator coolant directly to the hot cylinder head, is unique.

Coolant pressure drop across the thermostatic valve 44 in order to control the amount of coolant vapor in the head chamber 31 and the accumulation of coolant vapor upon the combustion dome jacket surface 27, is considered to be an important feature of the present invention. Because all known previous proportioning type thermostatic valves have been designed for conventional flow cooling direction without concern for addressing vapor and merely for a steady, stable, controlled coolant temperature rise without dips and swings, there is no valve that exhibits internal porting, valving and circuits that maximizes flow and minimizes pressure drop through the thermostatic valve.

Figure 2:
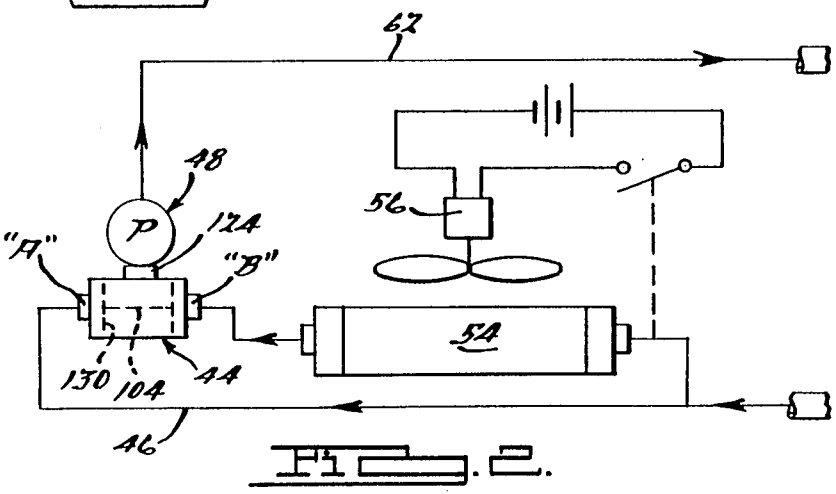
FIG. 2 is a schematic view of another cooling system utilizing the thermostat of the present invention.

FIG. 2 depicts a similar "draw-through" thermostatic valve 44 incorporated into the construction of the coolant pump 48 housing. The advantage of the thermostatic valve 44 being incorporated into the construction of the pump 48 is the elimination of external line complexity. Moreover, the thermostat 44 is moved to where it is directly acted upon by the impeller internal to the pump 48 which is the source of the pump's draw on the coolant. Because all line resistance between the pump 48 and the thermostatic valve 44 is eliminated the draw through the thermostatic valve 44 is maximized, and flow is increased.

The thermostat 44 as depicted in FIG. 2 would operate with the coolant ports in reverse of FIG. 1. Therefore a "full-flow" center port 124 constitutes a "full-flow" outlet from the thermostatic valve 44 into pump 48. The draw of the pump 48 continually pulls coolant through the outlet port 124 of the thermostatic valve 44 and the internal valve 104 would selective draw coolant in through either the by-pass port "A" or the main port "B" by action in the same manner as the valve 104 described with respect to FIG. 1, the only functional difference being that the coolant is now drawn "in" through the two alternating ports "A" and "B" and flows "out" through the single "full-flow" port 124. In some instances it is desirable to have a by-pass foot 130 spring loaded for closure upon by-pass port "A." This is typically done to increase the total distance available for movement of the valve 104 and to ease the tolerance required for total closure without excessive binding. When such spring loading of the foot 130 is employed, with the thermostatic valve 44 directly mounted upon the pump 48 or in other instances connected at length by a line to pump 48, it is extremely important to increase the spring pressure acting upon foot 130 when closing port "A" because the draw of the pump 48 is much higher on the internals of the thermostatic valve 44 when it is directly mounted upon, or acted upon, by pump 48.

Figure 3:
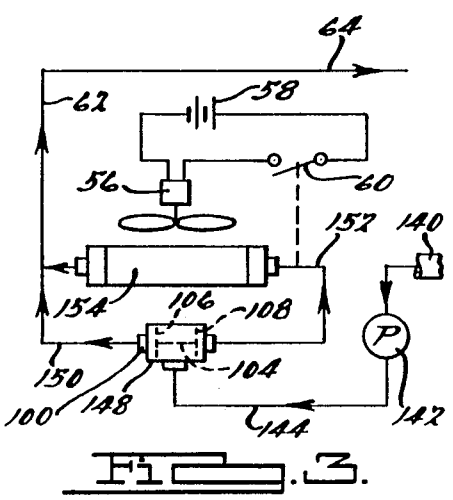

The system depicted in FIG. 3 is a typical reverse-flow, non-aqueous coolant system, as described in my U.S. Pat. No. 5,031,579. The preferred non-aqueous coolant for such a system is Propylene Glycol. Because the coolant is operated in an essentially water-free state, it is considerably more viscous than water or mixtures of water and anti-freeze both when it is cold and hot. For example, at 200° F. (93° C.) Propylene Glycol is approximately three times the viscosity of a 50/50 mixture of water and Ethylene Glycol anti-freeze. The more viscous nature of the Propylene Glycol anhydrous coolant requires that the most efficient porting and valving of the thermostatic valve be utilized. Additionally, it has been found that it is desirable, when using a highly viscous coolant, to place a thermostatic valve 148 on the positive pressure side of a coolant pump 142.

An additional benefit afforded when using the "push-through" thermostatic valve 148 of FIG. 3 is that the positive pressure flow of coolant acting upon the internal valving 104 of the thermostatic valve 48 will force the by-pass foot 106 tighter against a outlet port 100 thereof during periods when a by-pass line 150 is shut. The action of coolant pressure assists the by-pass foot 106 to remain closed, when the main valve 108 is open reducing the tendency for the by-pass foot 106 to be drawn open and the need for high spring pressure.

A further benefit of the placement of the thermostat 148 after the pump 142 is that the entire engine and the conduit 140 from the engine (not shown) to the pump 142, operates at a pressure below the pressure level in the radiator 54, the thermostat 148, and their related connecting lines 144 and 152.

While the preferred embodiment of the invention has been disclosed, it should be appreciated that the invention is susceptible of modification without departing from the scope of the following claims.

I claim:

1. In a reverse flow cooling system for an internal combustion engine, said system comprising a cylinder head cooling chamber on said engine, a coolant pump a radiator and a by-pass around said radiator, and wherein coolant flows from said radiator to said cylinder head cooling chamber via said pump, the improvement comprising a thermostatically controlled valve attached to the inlet side of said pump and adapted to selectively control the flow of coolant through the radiator and by-pass.

2. In a reverse flow cooling system for an internal combustion engine, said system comprising a cylinder head a cooling chamber on said engine, a coolant pump a radiator and a by-pass around said radiator, and wherein coolant flows from said radiator to said cylinder head cooling chamber via said pump, the improvement comprising a thermostatically controlled valve upstream of said pump adapted to selectively control the flow of coolant through the radiator and by-pass. wherein said valve exhibits closure pressure on a by-pass circuit when totally closed.

* * * * *